US005918828A

United States Patent [19]

Fabelje et al.

[11] Patent Number: 5,918,828

[45] Date of Patent: Jul. 6, 1999

[54] COP PREPARATION DEVICE FOR A BOBBIN-WINDING MACHINE

[75] Inventors: Uwe Fabelje, Mönchengladbach; Helmut Kohlen, Erkelenz; Stefan Terörde, Dingden, all of Germany

[73] Assignee: W. Schlafhorst AG & Co., Moenchengladbach, Germany

[21] Appl. No.: 08/984,962

[22] Filed: Dec. 4, 1997

[30] Foreign Application Priority Data

Dec. 7, 1996 [DE] Germany ..... 196 50 934

[51] Int. Cl.[6] ..... B65H 54/00

[52] U.S. Cl. ..... 242/475.8

[58] Field of Search ..... 242/475.8, 475.9, 242/476

[56] References Cited

U.S. PATENT DOCUMENTS

| | | | |
|---|---|---|---|
| 3,544,018 | 12/1970 | Warwick et al. | 242/475.9 |
| 4,619,416 | 10/1986 | Matsui et al. | 242/475.9 |
| 5,104,052 | 4/1992 | Wey et al. | 242/475.8 |
| 5,106,027 | 4/1992 | Wirtz et al. | 242/475.8 |
| 5,232,171 | 8/1993 | Hensen | 242/475.8 |
| 5,497,952 | 3/1996 | Iding | 242/475.8 |
| 5,556,046 | 9/1996 | Irmen et al. | 242/475.9 |

FOREIGN PATENT DOCUMENTS

| | | |
|---|---|---|
| 36 00 916 A1 | 7/1987 | Germany . |
| 40 39 486 A1 | 6/1992 | Germany . |
| 44 24 462 A1 | 1/1996 | Germany . |

*Primary Examiner*—Michael Mansen

*Attorney, Agent, or Firm*—Kennedy Covington Lobdell & Hickman LLP

[57] ABSTRACT

A suction arrangement for a device for repositioning the reserve winding typically found on cops from a ring spinning machine to prepare the cops for rewinding into larger yarn packages at a bobbin-winding machine. The suction device is connected to a central supply of suction air to aspirate and hold the yarn end until it is re-deposited on the cop, and includes an air flow restrictor plate movable among multiple positions for selectively obstructing the suction air flow to apply respectively different suction forces to the yarn end based on predetermined parameters of the yarn, the cop preparation operation, or the particular winding operation.

11 Claims, 5 Drawing Sheets

COP PREPARATION DEVICE FOR A BOBBIN-WINDING MACHINE

BACKGROUND OF THE INVENTION

The present invention relates to a cop preparation device for a bobbin-winding machine.

When the winding of cops on a ring spinning machine has been completed, the trailing yarn end is generally fixed or secured in position by forming a reserve winding extending downward to the tube foot before the spinning cops are doffed. However, the yarn end fixed at the tube foot cannot be reached by a grasping tube in the bobbin-winding machine which supplies the yarn end of a yarn connection device from a feeding or delivery bobbin and which fetches the yarn end of a freshly replaced cop for piecing-up the yarn.

For this reason a so-called preparation device is provided in bobbin-winding machines for detaching the reserve winding from the foot end of cops and placing the yarn end in a few windings on the upper tip end of the cop tube tip. From such disposition, the upper yarn end windings are blown off at the winding head, drawn into the grasping tube by suction and grasped. However, the preparation device can also be arranged to place the yarn end at any other defined position on the cop, e.g. inside the tube or on the circumferential surface of the yarn body.

DE 44 24 462 A1 teaches a cop preparation device operative to place the reserve winding of yarn as an upper winding. The cop to be prepared is positioned on a suction device adjacent to a suction tube having a slot on the side facing the spinning cop for drawing in the yarn end by suction and taking it up until it is laid down on the tube tip.

A blocking device for cutting the suction air on and off is arranged in the suction tube. The suction flow through the slot of the suction tube acts from point in time of the drawing in of the yarn end by suction until the point in time at which the yarn end has been wound onto the tube tip. The vacuum must be sufficiently great that the yarn end is loosened from the cop and drawn into the suction tube, which can be difficult for example in the case of stiff linen yarns. On the other hand, the yarn must not become frayed by the suction in the case of sensitive or fragile yarns. The yarn must not be held too slackly during the winding of the upper winding in order that the yarn windings remain on the tube tip.

SUMMARY OF THE INVENTION

It is accordingly a fundamental object of the present invention to provide an improved suction device for a cop preparation device in association with a bobbin-winding operation.

Briefly summarized, the cop preparation device of the present invention basically comprises means connected to a source of suction air flow for aspirating and holding an end of yarn from a cop preparatory to placement of the yarn end at a predetermined position on the cop, wherein the suction means comprises controllable means for adjustably varying the suction force of the suction air flow applied to the yarn end in relation to predetermined parameters preferably in the form of an air flow restrictor plate with an associated actuator means for selectively moving the air flow restrictor plate among plural positions within the suction air flow to apply respectively different suction forces to the yarn end.

The present invention makes it possible not only to switch the vacuum on and off in the suction device but also to regulate the vacuum in accordance with the particular requirements of the winding operation based on presettings or other predetermined guidelines or parameters. In the case of fine yarns or yarns with exposed surface fibers, the suction flow can be adjusted so that the vacuum is lower than in the case of smoothly surfaced or coarse yarns. The suction flow can be stronger, for example, when drawing in the yarn end during unwinding within the framework of the presetting by the yarn parameters than during the formation of the upper winding. The yarn end is always placed as an upper winding in accordance with the invention in a manner such that the yarn end can be blown off at the winding head of the bobbin-winding machine under uniform conditions from the tube and drawn in by the grasping tube, which largely avoids repeated attempts to separate or loosen the upper winding. The placement of the yarn end at other defined positions of the cop is also possible if the yarn end is placed with an adapted yarn tension.

The control of the vacuum takes place in a simple manner via a blocking device preferably in the form of an adjustable air flow restrictor plate. Stepping motors are advantageously suitable as an activator of the air flow restrictor plate. Since these motors rotate in presettable angular steps, they can be stopped upon any given number of angular steps and thus stopped in any desired position. As a result thereof, any desired opening cross section and therewith a corresponding vacuum can be set on the blocking device. Electromotors with a highly reducing transmission are also advantageously suited for actuating the air flow restrictor plate, in which case the positioning of the air flow restrictor plate is determined by the number of rotations of the output shaft of the transmission. Such motors make possible an individual adjustment of the air flow restrictor plate in the case of an alternating sequence of cops with different yarns, for example in a multi-batch operation.

The driving of an actuator of the air flow restrictor plate, especially of the aforesaid motors, can take place by a control unit or device in which the yarn parameters associated with a batch of cops and the associated process for placement of the yarn end are stored. In the case of a batch replacement, new data coordinated with each successive batch can be input or recalled from a memory storage device.

It is advantageous to identify the cops according to their association with a particular yarn batch. For such purpose, a reading device may be provided on the preparation device to read identifying data placed on the cops and to pass the data on to the control unit, which thereupon initiates the appropriate setting of the air flow restrictor plate in the blocking device and therewith the optimal particular vacuum. To this end the opening positions associated with the yarn parameters are stored in the control unit, e.g. in a memory storage device. The data for predetermining the opening positions can be obtained empirically, e.g., based on tests and experience. The identification of the cops can also be read for example from a data carrier associated with the particular cop to be prepared. Any other identification of the cops, e.g., by mechanical or optically scannable markings is also possible. In particular, in the case of a multi-batch operation with an alternating sequence of cops of different batches on the preparation device, the vacuum corresponding to the batch association of each cop thusly may be automatically associated with the cop.

A motor-driven cam disk is also suitable as an actuator of the air flow restrictor plate. A cam disk and its drive have a simple design. In the case of a cam disk, the sequence of the positions of the air flow restrictor plate are fixed. Any desired sequence of positions of the air flow restrictor plate can be determined by the appropriate shaping of the cam disk. The timing of the positions of the air flow restrictor plate can be varied by driving the cam disk at different speeds.

In general, the cops are delivered to the preparation device via transport devices such as pallets, so-called peg trays, or the like on which the cops are supported in upstanding vertical disposition, which assures a simple manipulation and good accessibility of the cops. However, it is also conceivable to prepare the cops while lying in a generally horizontal position, in which instance the cops can be stored for example on their tips.

Further features and advantages of the present invention will be understood from the following detailed description of an exemplary embodiment, and with reference to the accompanying drawings.

DESCRIPTION OF THE PREFERRED EMBODIMENTS

Figure 1:
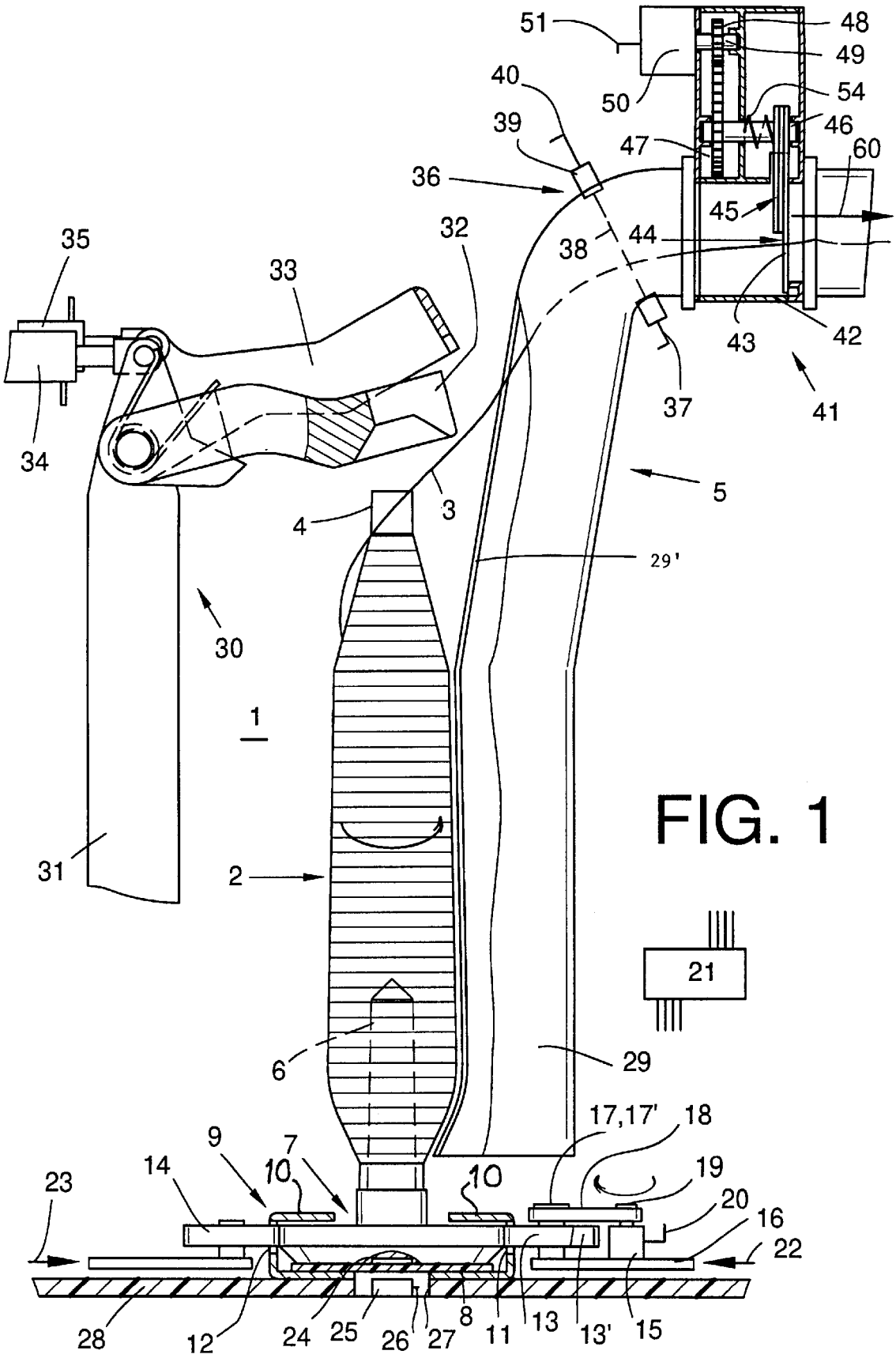
FIG. 1 is a side elevational view of a cop preparation device for a textile yarn winding machine according to the present invention, showing a cop during the unwinding of its yarn.

Referring now to the accompanying drawings and initially to FIG. 1, a cop preparation device 1 of a textile winding machine according to the present invention is shown in operation with a cop 2 standing on the preparation device 1 and with the yarn end 3 of the cop 2 having already been drawn into a suction device 5 preliminary to being placed as an upper winding onto the tip 4 of the cop's tube. The cop 2 is supported on a spindle or peg 6 of a transport disk 7 of the type commonly referred to as a peg tray or pallet. The transport disk 7 rests on a conveyor belt 8 of a cop transport system 9 for the winding machine wherein, in order to guide and retain transport disks 7 along the transport system 9, the conveyor belt 8 is enclosed along its longitudinal edges by a channel shaped guide conduit 10. The guide conduit 10 is formed with opposed openings 11, 12 through which extend roller means 13, 14 for rotating the transport disks 7 traveling with the conveyor belt 8.

The roller means comprises two drive rollers 13, 13' disposed in series with one another at the right side of the transport system 9, as viewed in FIG. 1, of which drive roller 13' is covered by drive roller 13. A single pressure roller 14 is arranged at the opposite side of the transport system 9 precisely between the two drive rollers 13, 13' to act laterally against transport disk 7 in order to center it and to assure a good frictional contact with drive rollers 13, 13'.

Drive rollers 13, 13' and an associated motor 15 are arranged on a common support plate 16. The rollers 13, 13' are rotatably mounted and are fixedly connected coaxially to respective belt disks 17, 17' engaged by a belt 18 which also extends about a belt disk 19 of the motor 15 so that a synchronous drive of the two drive rollers 13, 13' is assured. Motor 15 is connected via a control lead 20 to a control unit 21, such as a microprocessor or the like, by means of which the direction of rotation as well as the number of rotations of the motor 15 can be precisely controlled. This control unit can be a part of the main control device of the bobbin-winding machine with which the preparation device is associated.

The support plate 16 for the cop drive is mounted, in any suitable manner which need not be shown nor described here in detail, to be movable toward and away from the transport system 9 in the direction of arrow 22 to engage the transport disk 7. The devices necessary for such an arrangement are known from German Patent Publication DE 44 24 462 A1. Likewise, pressure roller 14 is mounted, also by means neither shown nor described herein but which may be comparable to the means known from German Patent Publication DE 44 24 462 A1, to be movable toward and away from the transport system 9 in the direction of arrow 23 to engage the transport disk 7.

Once the cop 2 supported on the transport disk 7 has assumed the position in preparation device 1 as shown in FIG. 1, drive rollers 13, 13' as well as pressure roller 14 are moved inwardly toward on another indicated by the arrows 22 and 23 and the disk 7 and cop 2 are rotated as a unit in an unwinding direction indicated by the arrow on the cop in FIG. 1. At the same time, identifying data concerning the yarn on the cop 2 stored in chip 24 on the transport disk 7, which for example includes information about the yarn batch and therewith about the yarn parameters, is read by a reading device 25 supported by the winding machine frame 28 in an opening 27 in the guide conduit 10 by which such identifying data is transmitted via an electrical lead 26 to the control unit 21.

A suction device 5 is provided which consists of an elongate tube 29 oriented generally vertically alongside the cop 2 at the position of the roller means 13, 14, the tube being closed at its lower end immediately above the transport device 9 and extending therefrom to a location substantially above the upper tip 4 of the cop tube. The tube 29 is connected to a vacuum source (not shown) and is formed with a slot 29' extending in the lateral side thereof facing the cop 2 from the lower end of the tube to a terminal point above the tip 4 of the cop 2.

A device 30 for forming an upper winding of yarn on the tip 4 of the cop tube is located on the other side of transport system 9 opposite suction device 5. This device 30 includes a centering arm 32 and a catch frame 33 pivotably arranged on a holder 31 to be actuated for example by pneumatic cylinders 34, 35 which can be controlled by control unit 21. The catch frame 33 guides the yarn 3 onto the tube tip 4 during the formation of the upper yarn winding while the centering flap 32 holds the cop 2 in a centered disposition. German Patent Publication DE 44 24 462 A1 illustrates and describes in detail such a device 30 for forming an upper yarn winding on a yarn cop.

FIG. 1 illustrates the situation in which the end of yarn 3 has already been drawn into suction tube 29. The presence of yarn 3 within the tube 29 is detected by a sensor 36. In the present exemplary embodiment, the sensor 36 operates by the yarn 3 interrupting or weakening a light beam 38 emitted by an optical emitter 37, which is detected by a receiver 39 and a detection signal transmitted via signal lead 40 to control unit 21.

Yarn sensor 36 is located directly in front of a blocking device 41 which comprises a housing 42 surrounding tube 29. The housing 42 comprises an air flow restrictor plate 43 selectively movable within the housing 42 across the interior suction airflow passageway 44 through the tube 29 to fully obstruct, partially obstruct or leave completely unobstructed the interior passageway 44 of the tube at its connection to the housing 42, thereby to selectively control the suction effect of the upstream vacuum source on the tube 29. Shears 45 for cutting the yarn are arranged in front of air flow restrictor plate 43, as viewed in the direction of suction flow 60. One shearing leaf 53 of the shears 45 is fixed adjacent the opening 44 while the other shearing leaf 52 is mounted with the air flow restrictor plate 43 on a common shaft 46 for movement across the interior opening 44 of the tube 29. A spring 54 arranged around the shaft 46 presses the two shearing leafs 52, 53 against one another under tension. A toothed segment gear 47 is fastened on the shaft 46 and meshes with a pinion gear 48 mounted on the shaft 49 of a drive motor 50 which serves as the actuator for the air flow restrictor plate 43. In the present exemplary embodiment, the motor 50 is a stepping motor and is controlled via a control lead 51 by control unit 21 such that the air flow restrictor plate 43 can close, partially restrict or open the opening 44 to any given selected degree.

Figure 2:
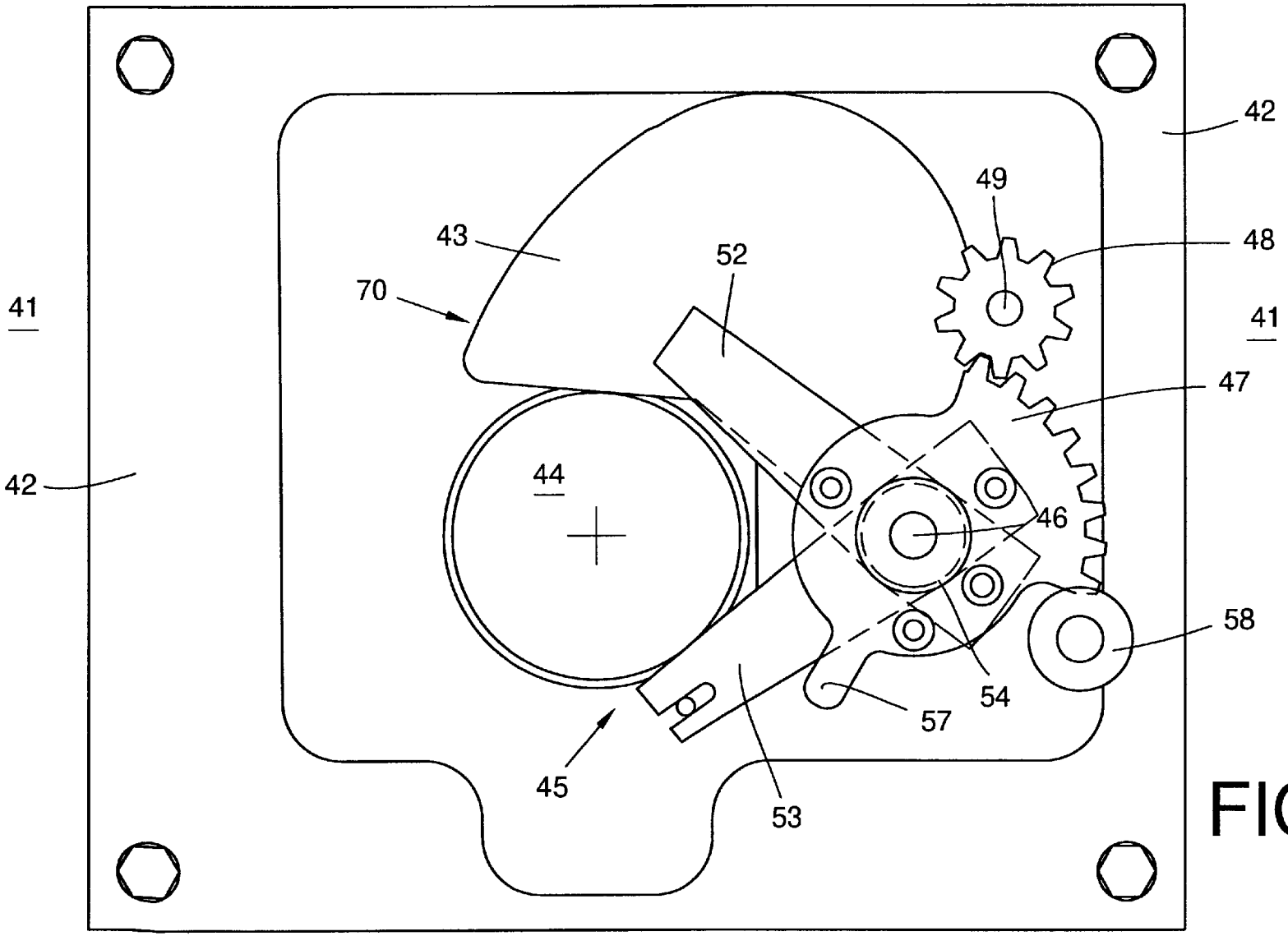
FIG. 2 is a front elevational view of the open housing of the cop preparation device of FIG. 1, with the blocking device thereof disposed with the air flow restrictor plate in an open condition.
Figure 3:
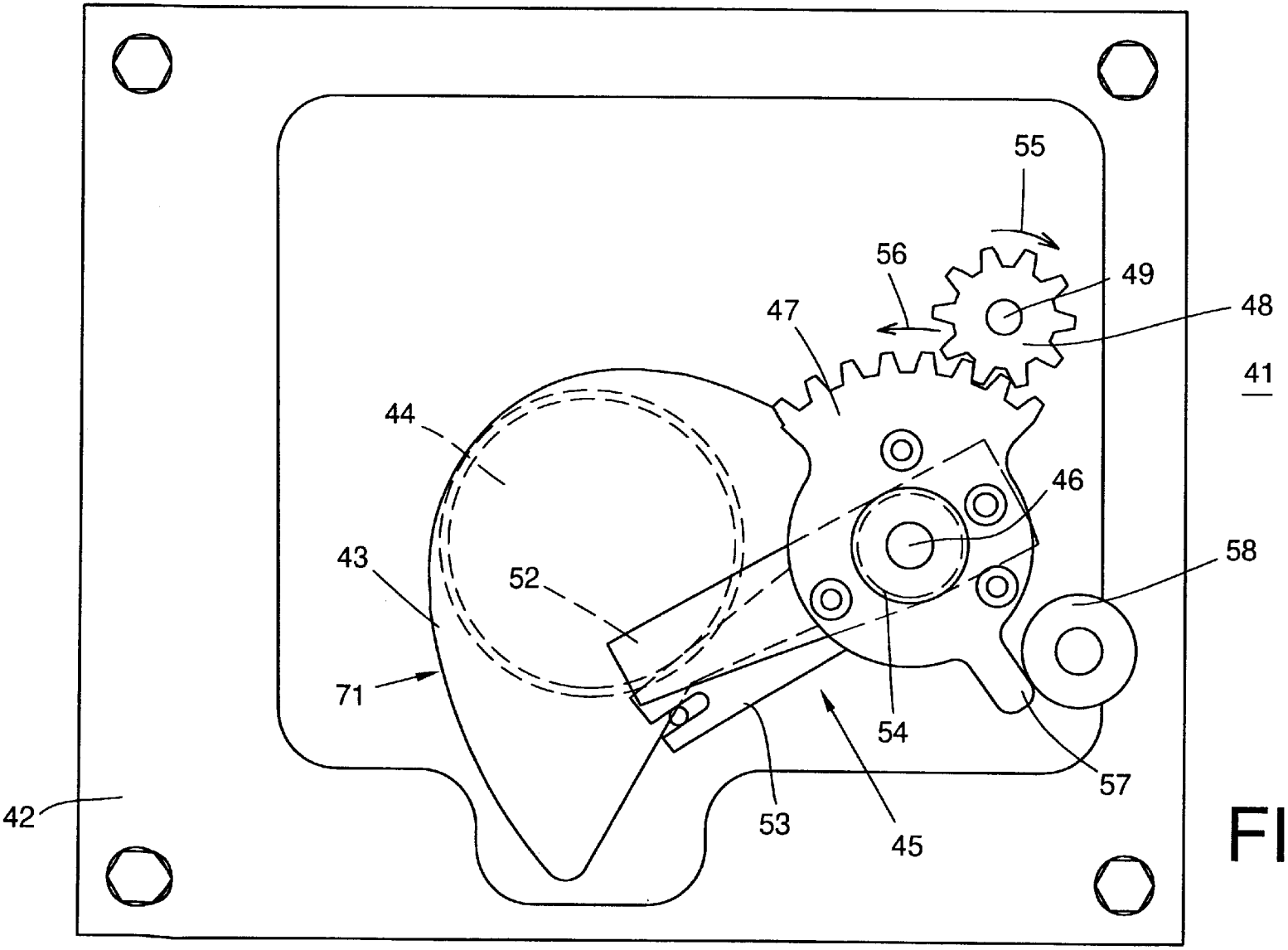
FIG. 3 is another front elevational view of the open housing of the cop preparation device similar to FIG. 2, but with the blocking device thereof disposed with the air flow restrictor plate in a closed condition.
Figure 4:
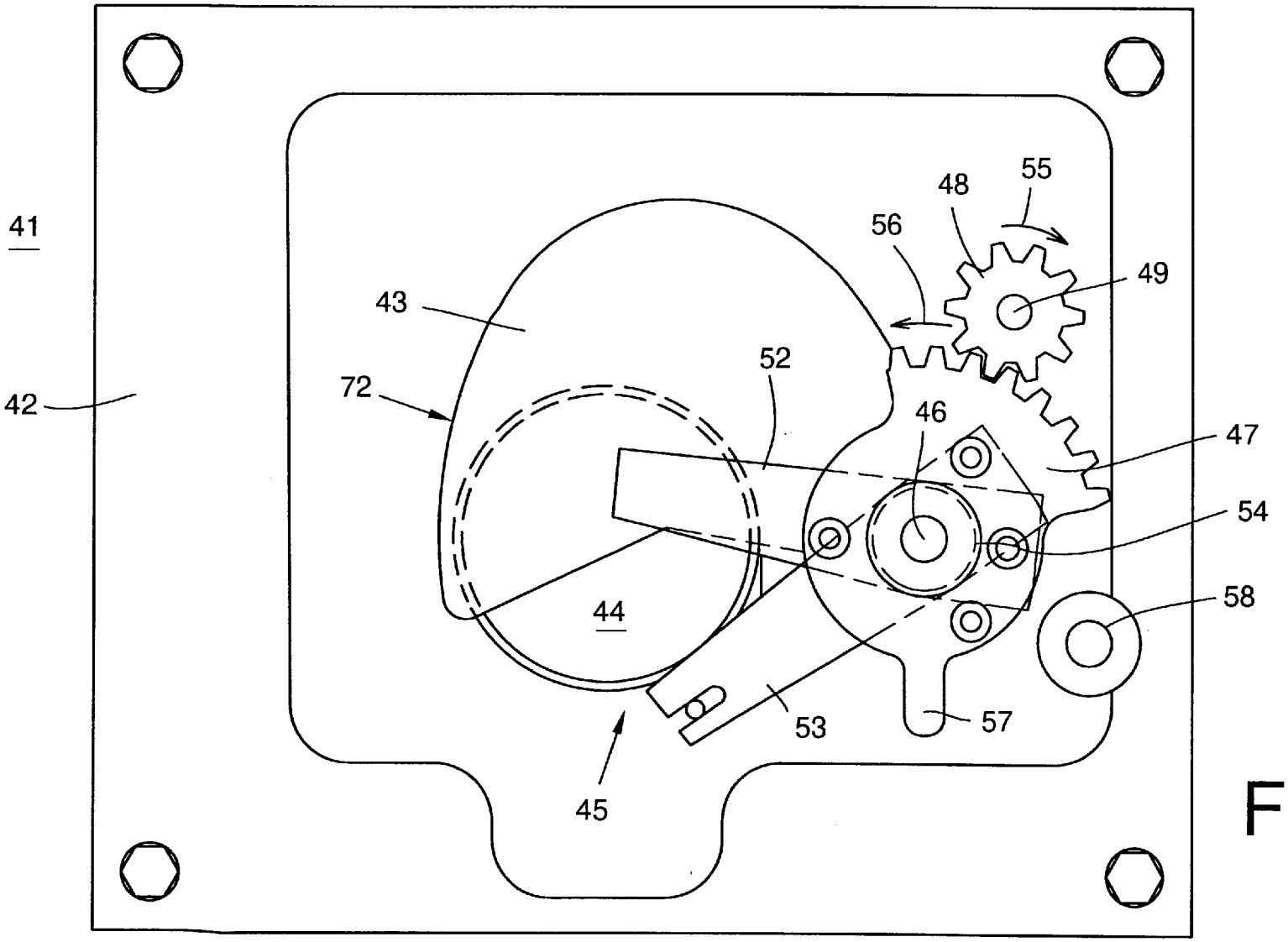
FIG. 4 is another front elevational view of the open housing of the cop preparation device similar to FIGS. 2 and 3, but with the blocking device thereof disposed with the air flow restrictor plate in a partially closed condition.

FIGS. 2 to 4 depict the housing 42 of the blocking device 41, as viewed in the direction of suction air flow, with the housing cover plate removed to reveal the interior components thereof, particularly air flow restrictor plate 43, in differing operative states and with the motor 50 omitted for the sake of clarity.

As aforedescribed, the pinion 48 is affixed on the motor shaft 49 in meshing engagement with the toothed segment gear 47 which is fixed on parallel shaft 46, thereby to drive reciprocation of the shaft 46 by the angular extent of the segment gear 47. Air flow restrictor plate 43 is also fastened to shaft 46 immediately adjacent to the opening 44 of the tube 29. The movable shearing leaf 52 of the shears 45 is located axially adjacent the upstream side of the air flow restrictor plate 43. The second shearing leaf 53 is fixed to housing 42 with its cutting edge outside of opening 44, with the shaft 46 being freely movable relative to this shearing beam.

FIG. 2 shows the air flow restrictor plate 43 in its outermost position 70 in which the entire plate is withdrawn from the opening 44 of the tube 29 to fully open the tube opening 29 to unrestricted suction air flow. The shears 45 likewise are completely open. The toothed segment 47 rests on a stop 58.

FIG. 3 shows the air flow restrictor plate 43 in its fully closed position 71 completely obstructing suction air flow through the tube opening 44. To effect this positioning of the plate 43, the motor 50 is actuated to drive the pinion 48 in the direction of arrow 55, as a result of which the toothed-segment gear 47 moves counterclockwise in the direction of arrow 56, thereby producing corresponding movement of the shaft 46 and the air flow restrictor plate 43 and shear leaf 52 thereon. When opening 44 is completely closed by air flow restrictor plate 43, a nose 57 of toothed-segment gear 47 rests on stop 58 and shears 45 are closed.

The intermediate position 71 shown in FIG. 3 is assumed by air flow restrictor plate 43 after the yarn drawn into tube 29 has been cut to the proper length required for forming the upper winding, i.e. after the plate 43 and the shears 45 have been moved from position 70 of FIG. 2 to the position 71 of FIG. 3. When the yarn is cut the aforementioned rotation of the cop 2 in the direction of unwinding is halted. The blocking device 41 is positioned along the tube 29 such that, when yarn 3 is cut by the shears 45, the yarn has the length required for the formation of the upper winding. As is already known from German Patent Publication DE 44 24 462 A1, the yarn length available for forming the upper winding can be enlarged by a desired yarn length by opening the air flow restrictor plate 43 after the cutting of the yarn while the cop is rotated further by a precisely defined number of rotations in the direction of unwinding.

In FIG. 4, air flow restrictor plate 43 covers over one half of opening 44 in its position 72. By thereby changing the cross section of the opening 44, the suction flow is increased in a corresponding manner and therewith the vacuum prevailing at opening 44 and, in turn, the vacuum prevailing at slot 30.

Position 72 of air flow restrictor plate 43 shown in FIG. 4 is selected in particular when the yarn end of the separated reserve winding is to be drawn into tube 29, because the more the opening 44 is closed by the air flow restrictor plate 43 the greater the suction flow present within the opening 44 and thus the greater the prevailing vacuum in tube 29. Alternatively, in order not to wind the upper winding too tightly, it can be advantageous if the fully open position 70 of air flow restrictor plate 43 shown in FIG. 2 is selected. As has already been explained, it is possible according to the invention to bring air flow restrictor plate 43 into such a position via control unit 21 based on the yarn parameters associated with the cop and based on an adaptation to the particular winding process underway at the winding machine so that an optimum vacuum prevails at slot 30.

Figure 5:
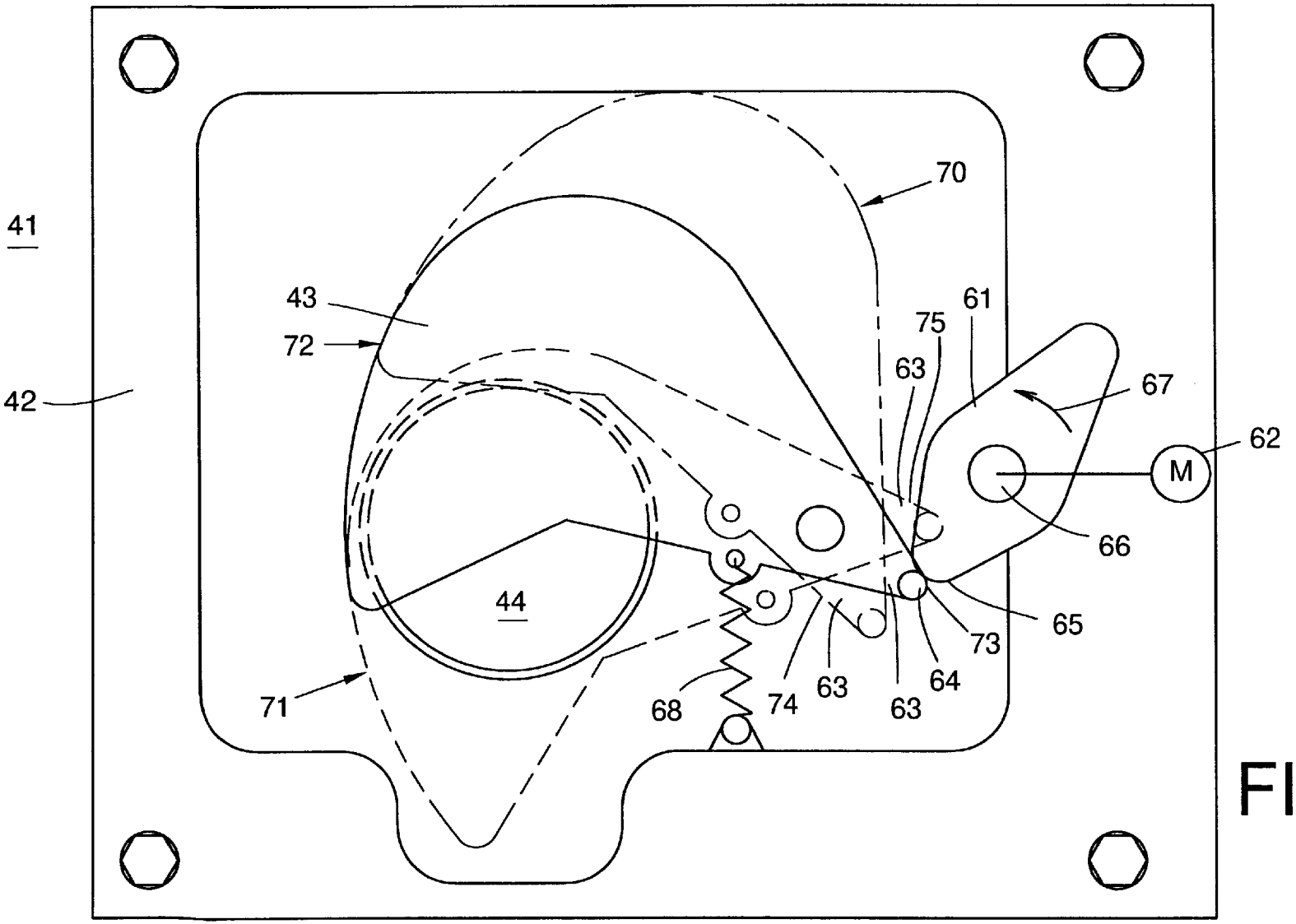
FIG. 5 is a further front elevational view of the open housing of the cop preparation device similar to FIGS. 2–4, but showing an alternate embodiment wherein the blocking device comprises a cam disk as the activator of the air flow restrictor plate.

In FIG. 5, an alternative embodiment is shown wherein a cam disk 61 driven by a motor 62 serves as the actuator for driving movements of the air flow restrictor plate 43. The air flow restrictor plate 43 is rotatably mounted on a shaft 46 and is shown in its partially open position 72 represented in the first embodiment in FIG. 4. The yarn cutting shears are not shown for the sake of clarity. The air flow restrictor plate 43 of this embodiment is formed with a cam lobe 63 having a cam roller 64 at the end thereof to rest in following relation on outer contour 65 of cam disk 61. The contour of the cam disk 61 and the cam lobe 63 are selectively coordinated to accomplish the particular desired sequence of positions of the air flow restrictor plate. The cam disk 61 can be replaced by another cam disk with a different contour, e.g., in the case of a batch change.

In this embodiment, the air flow restrictor plate 43 normally rests in the fully closed position 71 when the blocking device is in its non-actuated state under the biasing force of a spring 68 fastened between the housing 42 and the air flow restrictor plate 43. In such state of the blocking device, the cam disk 61 is disposed in a corresponding closed position abutting the roller 64 on the cam lobe 63 at 75. In order to actuate opening movements of the air flow restrictor plate, the cam disk 61 is rotated on its shaft 66 by motor 62 in the direction of arrow 67 to initially press the cam lobe 63 into the position indicated at 74 and thereby to advance the restrictor plate 43 into the fully open position 70. Upon continued advancement of the cam disk 61, the cam lobe 63 follows into the position 73 to pivot the air flow restrictor plate into its partially open position 72 shown in full lines.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cop preparation device for a bobbin-winding operation comprising suction means connected to a source of suction air flow for aspirating and holding an end of yarn from a cop preparatory to placement of the yam end at a predetermined position on the cop, the suction means comprising means defining a suction air flow passageway and controllable means for adjustably varying the suction force of the suction air flow applied to the yarn end in relation to predetermined parameters, the controllable means comprising means movable between a fully open position wherein suction air flow in the passageway is essentially unobstructed, a fully closed position wherein the passageway is essentially fully obstructed to prevent suction air flow therein, and at least one intermediate partially open position between the fully open and fully closed positions wherein the passageway is only partially obstructed for reduced suction air flow therein.

2. The cop preparation device according to claim 1, wherein the movable means comprises an air flow restrictor plate and actuator means for selectively moving the air flow restrictor plate among plural positions within the suction air flow passageway to apply respectively different suction forces to the yam end.

3. The cop preparation device according to claim 2, wherein the plural positions of the air flow restrictor plate are selected in relation to parameters of the cop preparation process.

4. The cop preparation device according to claim 2, wherein the plural positions of the air flow restrictor plate are selected in relation to parameters of the yarn being wound.

5. The cop preparation device according to claim 2, wherein the actuator means for the air flow restrictor plate comprises a stepping motor and a controller for determining the angular steps of the stepping motor for the plural positions of the air flow restrictor plate.

6. The cop preparation device according to claim 2, wherein the actuator means for the air flow restrictor plate comprises a motor, a reducing transmission connecting the motor with the air flow restrictor plate and a controller for determining the revolutions of the motor for the plural positions of the air flow restrictor plate.

7. The cop preparation device according to claim 2, wherein the actuator means for the air flow restrictor plate comprises selectively rotatable cam means.

8. The cop preparation device according to claim 1, wherein the controllable means stores yarn parameters associated with a batch of cops being wound and the positions of the air flow restrictor plate associated with particular cop preparation operations.

9. The cop preparation device according to claim 1, wherein the cop has an associated data carrier identifying parameters of the yarn on the cop, the controllable means comprising a device for reading the data carrier and being arranged for controlling the actuator means for setting the position of the air flow restrictor plate as a function of the yarn parameters.

10. The cop preparation device according to claim 9, wherein the data carrier comprises a readable memory storage device associated with the cop to be prepared.

11. The cop preparation device according to claim 1, wherein the movable means is movable between a plurality of differing intermediate partially open positions each partially obstructing the suction air flow passageway to differing degrees.

* * * * *